US006272075B1

(12) United States Patent
Paganelli et al.

(10) Patent No.: US 6,272,075 B1
(45) Date of Patent: Aug. 7, 2001

(54) MULTI FUNCTIONAL ANALOG DIGITAL WATCH

(76) Inventors: Robert L. Paganelli, 13 Hampton Village Dr., Granby, CT (US) 06035; Kristine K. Brown, 994 Mott Hill Rd., S. Glastonbury, CT (US) 06073

( * ) Notice: Subject to any disclaimer, the term of this patent is extended or adjusted under 35 U.S.C. 154(b) by 0 days.

(21) Appl. No.: 09/323,908

(22) Filed: Jun. 2, 1999

(51) Int. Cl.[7] ..... G04B 47/00; G04C 19/00
(52) U.S. Cl. ..... 368/10; 368/82
(58) Field of Search ..... 368/10, 82–84, 368/80, 223, 239–242

(56) References Cited

U.S. PATENT DOCUMENTS

| | | | | |
|---|---|---|---|---|
| D. 312,416 | | 11/1990 | Braun | D10/38 |
| D. 347,583 | | 6/1994 | Elkins, III | D10/32 |
| 4,216,649 | | 8/1980 | Ichikawa et al. | 368/109 |
| 4,400,092 | | 8/1983 | Piquet et al. | 368/82 |
| 4,493,043 | * | 1/1985 | Forbash | 364/565 |
| 4,712,923 | | 12/1987 | Martin | 368/10 |
| 4,896,306 | | 1/1990 | Sanbongi et al. | 368/29 |
| 4,905,213 | | 2/1990 | Masse et al. | 368/10 |
| 4,975,842 | * | 12/1990 | Dacrow et al. | 364/413.02 |
| 5,157,640 | | 10/1992 | Backner | 368/10 |
| 5,222,053 | * | 6/1993 | Ohhira | 368/73 |
| 5,228,449 | * | 7/1993 | Christ et al. | 128/691 |
| 5,337,290 | | 8/1994 | Ventimiglia et al. | 368/10 |
| 5,572,421 | * | 11/1996 | Altman et al. | 395/203 |
| 5,902,234 | * | 5/1999 | Webb | 600/300 |

* cited by examiner

*Primary Examiner*—Vit Miska
(74) *Attorney, Agent, or Firm*—Richard C. Litman

(57) ABSTRACT

A multi functional analog digital watch including an analog display area, a digital display area, and a band. The multi functional analog digital watch also includes four push buttons which are intended for actuation by the user of the watch for controlling different functions including a light, changing modes in the digital display area between the time, the date, a timer, a stopwatch, and life saving instructions related to basic Cardiopulmonary Resuscitation. The timer countdowns a preset period of time up to twenty-four hours. The stopwatch measures elapsed time up to twenty-four hours. The multi functional analog digital watch also includes a twenty-four hour alarm which can be set to the minute and provide an audible beep that sounds for a predetermined amount of time. The multi functional analog digital watch has the ability to display a sequence of life saving instructions related to basic Cardiopulmonary Resuscitation in a scrolling manner on the digital display.

7 Claims, 1 Drawing Sheet

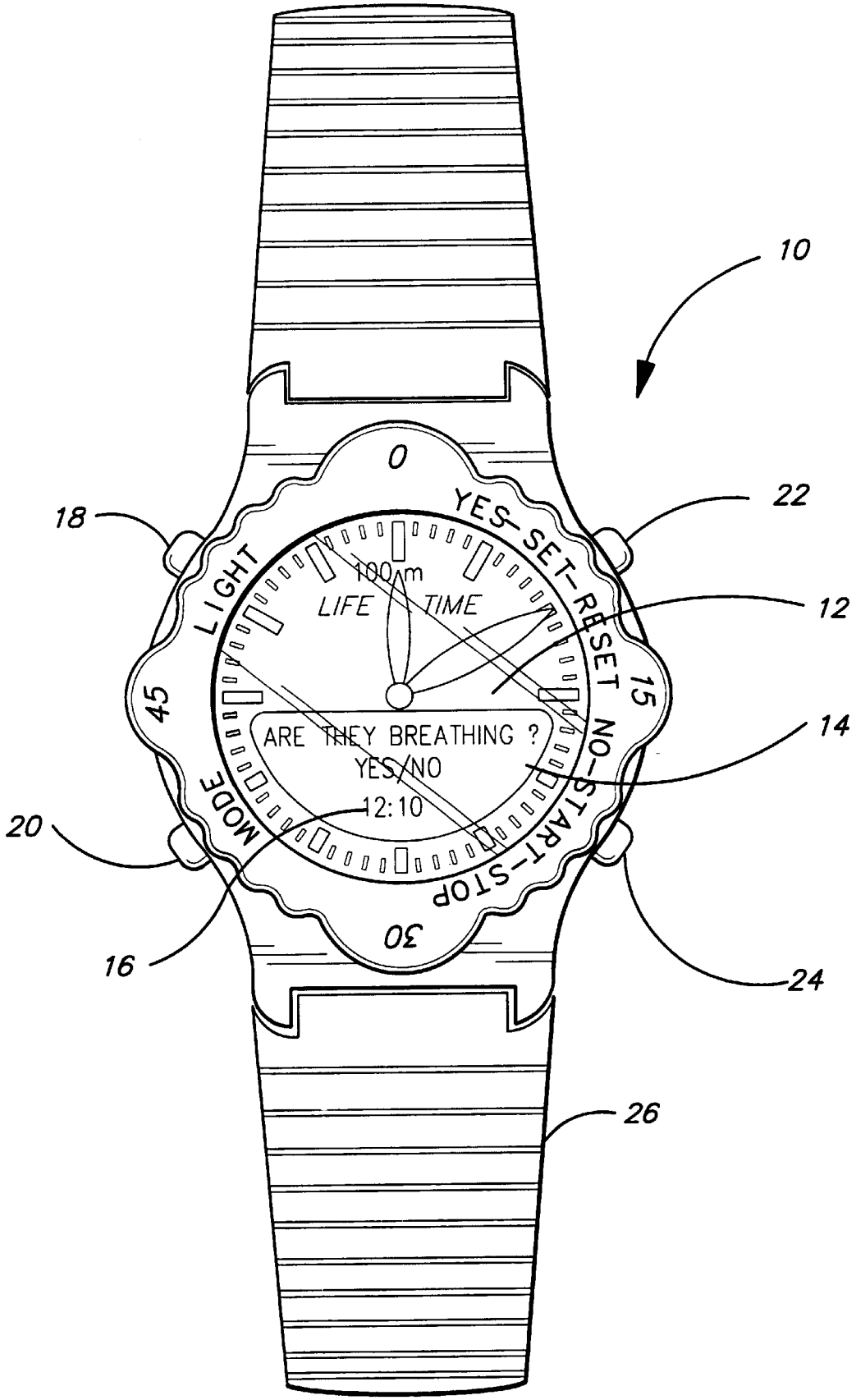
10
0
YES-SET-RESET
NO-START-STOP
15
30
45
LIGHT
MODE
100m
LIFE TIME
ARE THEY BREATHING ?
YES/NO
12:10
12
14
16
18
20
22
24
26

MULTI FUNCTIONAL ANALOG DIGITAL WATCH

BACKGROUND OF THE INVENTION

1. Field of the Invention

The present invention relates generally to electronic timepieces and, more specifically, to a multi functional watch provided with life saving instructions related to basic Cardiopulmonary Resuscitation (CPR) that can be displayed on a scrolling digital display.

2. Description of Related Art

CPR training is taught to many professional medical personnel, who use it often, as well as many non medical people who may never have the occasion to use the technique. Many of these people follow up with refresher courses. However, in a life or death emergency, some of the steps described in the CPR training courses may not be remembered. Training is common for both groups, and, such training will be enhanced by this invention. The related art is represented by the following patents of interest.

U.S. Pat. No. 312,416, issued on Nov. 27, 1990 to Refaei Braun, shows a dual display digital stop watch. Braun does not suggest a multi functional analog digital watch according to the claimed invention.

U.S. Pat. No. 347,583, issued on Jun. 7, 1994 to Jahn A. Elkins, III, shows a combined watch and medical information display. Elkins, III does not suggest a multi functional analog digital watch according to the claimed invention.

U.S. Pat. No. 4,216,649, issued on Aug. 12, 1980 to Singo Ichikawa et al., describes a function selection circuit for a multi function timepiece. Ichikawa et al. do not suggest a multi functional analog digital watch according to the claimed invention.

U.S. Pat. No. 4,400,092, issued on Aug. 23, 1983 to Christian Piquet et al., describes an analogue and digital display. Piquet et al. do not suggest a multi functional analog digital watch according to the claimed invention.

U.S. Pat. No. 4,712,923, issued on Dec. 15, 1987 to Victor G. Martin, describes an electronic calendar and a method for randomly selecting and displaying messages. Martin does not suggest a multi functional analog digital watch according to the claimed invention.

U.S. Pat. No. 4,896,306, issued on Jan. 23, 1990 to Masao Sanbongi et al., describes an electronic scheduler capable of searching schedule data based on time. Sanbongi et al. do not suggest a multi functional analog digital watch according to the claimed invention.

U.S. Pat. No. 4,905,213, issued on Feb. 27, 1990 to Viola H. Masse et al., describes a medication reminder. Masse et al. do not suggest a multi functional analog digital watch according to the claimed invention.

U.S. Pat. No. 5,157,640, issued on Oct. 20, 1992 to Brian P. Backner, describes a medication alert watch and system. Backner does not suggest a multi functional analog digital watch according to the claimed invention.

U.S. Pat. No. 5,437,290, issued on Aug. 9, 1994 to Phillip Ventimiglia et al., describes a health watch. Ventimiglia et al. do not suggest a multi functional analog digital watch according to the claimed invention.

None of the above inventions and patents, taken either singly or in combination, is seen to describe the instant invention as claimed.

SUMMARY OF THE INVENTION

The present invention is a multi functional analog digital watch comprising an analog display area, a digital display area, and a band. The multi functional analog digital watch is preferably water resistant to a minimum of 100 meters. Preferably, the band is a 100% stainless steel 'link' style band that matches the water resistant qualities of the watch. The multi functional analog digital watch also comprises four pushbuttons which are intended for actuation by the user of the watch for controlling different functions thereof such a light, changing modes in the digital display area between the time, the date, a timer, a stopwatch, life saving instructions related to basic CPR, etc. The timer countdowns a preset period of time up to twenty-four hours. The stopwatch measures elapsed time up to twenty-four hours. The watch also includes a twenty-four hour alarm which can be set to the minute and provide an audible beep that sounds for a predetermined amount of time, such as twenty seconds. The main novelty of the watch resides in its ability to display a sequence of life saving instructions related to basic CPR in a scrolling manner on the digital display.

The analog display area includes a sweep seconds-hand, a sweep minutes-hand, and a sweep hours-hand. The hands are driven by conventional stepping motors and a time-display wheel train. The digital display area comprises means, such as a liquid crystal display (LCD), for displaying two or more lines of alphanumeric characters. Depending on the mode selected by the user, the digital display is used to display either the time, the date, a timer, a stopwatch, or life saving instructions related to basic CPR.

The multi functional analog digital watch also includes a microcomputer, which comprises a data memory in the form of a random access memory, combined with a programmable logic unit. In conventional manner, the memory contains a main program and a series of sub-programs intended to perform the different desired functions. For example, one of the sub-programs is intended for computing the real time, another for setting the watch, another for making it possible to ascertain which pushbutton has been pressed and what function of the watch is to be performed, in response to such pressing of a pushbutton and depending on the state of the watch, etc. All circuits are energized by means of a battery.

The multi functional analog digital watch has four pushbuttons. The pushbuttons include a LIGHT button, a MODE button, a YES-SET-RESET button, and a NO-START-STOP button. The LIGHT button is used to illuminate the analog display area and the digital display area with means such as an 'Indiglo' type light, etc. The MODE button is used to enable the user to switch watch functions displayed on the digital display area between the time, the date, a timer, a stopwatch, and life saving instructions related to basic CPR. The YES-SET-RESET button is used to set and reset times for the timer or stopwatch, and provides a "yes" response for responding to the life saving instructions. The NO-START-STOP button starts and stops the operation of the timer or stopwatch, and provides a "no" response for responding to the life saving instructions.

The watch functions to provide life saving instructions related to basic CPR by having the user depress the MODE button until "LifeTime" appears in the LCD digital display area. Once "LifeTime" appears in the LCD digital display area, the user depresses the YES-SET-RESET button once. The user will be prompted to answer each question noted below through the scrolling LCD screen. Each question is answered by the user through depression of either the YES-SET-RESET button for a "yes" response or the NO-START-STOP button for a "no" response. The watch will register each answer and automatically program the proper sequence of emergency instructions, based on the situation, that are preferably obtained from appropriate authorities (i.e., the Red Cross, the American Heart Association, etc.). The initial questions may include: "Is the victim an infant?"; "Is victim choking?"; "Is victim breathing?"; and "Does victim have a pulse?".

For child and adult choking victims, emergency instructions, preferably obtained from appropriate authorities (i.e., the Red Cross, the American Heart Association, etc.), that are displayed in a scrolling manner on the LCD digital display area may include: "Dial 911 if possible for assistance."; "Perform abdominal thrusts until the object comes out."; "If victim is unconscious, clear airways of any obstructions."; "Administer 2 slow breaths."; and "If air won't go in, give five abdominal thrusts. Repeat these steps until air goes in the victim or help arrives.". A separate set of instructions for infants will be displayed for infants requiring emergency procedures. Once the user has visually observed all of the instructions on the scrolling digital LCD display, the instructions begin to repeat themselves. The watch will provide audible beeps to assist the user in timing the frequency of breaths or compressions/breaths that should be administered. A single low-pitch beep will alert the user when each compression should be performed and two short, quick, high-pitched peeps when rescue breathing is required.

For child and adult victims not breathing, emergency instructions, preferably obtained from appropriate authorities (i.e., the Red Cross, the American Heart Association, etc.), that are displayed in a scrolling manner on the LCD digital display area may include: "Dial 911 if possible for assistance."; "Tilt head back, lift chin, pinch nose."; "Give 2–3 slow breaths."; "Check for breathing—'look, listen and feel.'"; "Check Carotid pulse in neck for 10 seconds."; and "If pulse but no breathing, start rescue breathing—1 breath every 4 to 5 seconds.". A separate set of instructions for infants will be displayed for infants requiring emergency procedures. Once the user has visually observed all of the instructions on the scrolling digital LCD display, the instructions begin to repeat themselves. The watch will provide audible beeps to assist the user in timing the frequency of breaths or compressions/breaths that should be administered. A single low-pitched beep will alert the user when each compression should be performed and two short, quick, high-pitched peeps when rescue breathing is required.

For child and adult victims not breathing and having no pulse, emergency instructions, preferably obtained from appropriate authorities (i.e., the Red Cross, the American Heart Association, etc.), that are displayed in a scrolling manner on the LCD digital display area may include: "Dial 911 if possible for assistance."; "Perform compression/breathing cycles—4 cycles or 15 compressions and 2 slow breaths (12–5 seconds per cycle)."; "Observe chest rise and fall, listen and feel for escaping air."; and "Check Carotid pulse in the neck for 5 seconds, repeat steps until victim is breathing or help arrives.". A separate set of instructions for infants will be displayed for infants requiring emergency procedures. Once the user has visually observed all of the instructions on the scrolling digital LCD display, the instructions begin to repeat themselves. The watch will provide audible beeps to assist the user in timing the frequency of breaths or compressions/breaths that should be administered. A single low-pitch beep will alert the user when each compression should be performed and two short, quick, high-pitched peeps when rescue breathing is required.

Accordingly, it is a principal object of the invention to provide a multi functional analog digital watch comprising an analog display area, a digital display area, a band, and the ability to display a sequence of life saving instructions related to basic CPR in a scrolling manner on the digital display.

It is another object of the invention to provide a multi functional analog digital watch comprising four push buttons which are intended for actuation by the user of the watch for controlling different functions thereof including a light and changing modes in a digital display area between the time, the date, a timer, a stopwatch, life saving instructions related to basic CPR.

It is an object of the invention to provide improved elements and arrangements thereof in a multi functional analog digital watch for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The sole FIGURE is a top view of a multi functional analog digital watch according to the present invention.

DETAILED DESCRIPTION OF THE PREFERRED EMBODIMENT

Referring to the FIGURE, the numeral 10 refers to a multi functional analog digital watch according to the invention that includes an analog display area 12, a digital display area 14, and a band 26. The multi functional analog digital watch 10 is preferably water resistant to a minimum of 100 meters, as designated by the representation under the twelve o'clock position. Preferably, the band 26 may be a 100% stainless steel "link" style band that matches the water resistant qualities of the watch 10. The illustrative watch 10 also comprises four push buttons 18,20,22,24 which are intended for actuation by the user of the watch 10 for controlling different functions thereof such as a light, changing modes in the digital display area 14 between the time, the date, a timer, a stopwatch, life saving instructions related to basic CPR, etc. The timer countdowns a preset period of time up to twenty-four hours. The stopwatch measures elapsed time up to twenty-four hours. The watch also includes a twenty-four hour alarm which can be set to the minute and provide an audible beep that sounds for a predetermined amount of time, such as twenty seconds.

The analog display area 12 includes a sweep seconds-hand, a sweep minutes-hand, and a sweep hours-hand. The hands are driven by conventional stepping motors and a time-display wheel train. The digital display area 14 comprises means, such as an LCD, for displaying two or more lines of alphanumeric characters. Depending on the mode selected by the user, the digital display area 14 is used to display either the time, the date, a timer, a stopwatch, or life saving instructions related to basic CPR.

The multi functional analog digital watch 10 also includes a microcomputer (not shown), which comprises a data memory in the form of a random access memory, combined with a programmable logic unit. The design of the microcomputer is of a generally known type and therefore need not be described in greater detail. In conventional manner, the memory contains a main program and a series of sub-programs intended to perform the different desired functions. For example, one of the sub-programs is intended for computing the real time, another for setting the watch, another for making it possible to ascertain which pushbutton has been pressed and what function of the watch is to be performed, in response to such pressing of a pushbutton and depending on the state of the watch, etc. All circuits are energized by means of a battery not shown.

The multi functional analog digital watch 10 has four pushbuttons 18,20,22,24. The pushbuttons include a LIGHT button 18, a MODE button 20, a YES-SET-RESET button 22, and a NO-START-STOP button 24. The LIGHT button 18 is used to illuminate the analog display area 12 and the digital display area 14 with means such as an 'Indiglo' type light, etc. The MODE button 20 is used to enable the user to switch watch functions displayed on the digital display area 14 between the time, the date, a timer, a stopwatch, and life saving instructions related to basic CPR. The YES-SET-RESET button 22 is used to set and reset times for the timer or stopwatch, and provides a "yes" response for responding to the life saving instructions. The NO-START-STOP button 24 starts and stops the operation of the timer or stopwatch, and provides a "no" response for responding to the life saving instructions.

The watch functions to provide life saving instructions related to basic CPR by having the user depress the MODE button 20 until "LifeTime" appears in the LCD digital display area 14. Once "LifeTime" appears in the LCD digital display area 14, the user depresses the YES-SET-RESET button 22 once. The user will be prompted to answer each question noted below through the scrolling LCD screen. Each question is answered by the user through depression of either the YES-SET-RESET button 22 for a "yes" response or the NO-START-STOP button 24 for a "no" response. The watch will register each answer and automatically program the proper sequence of emergency instructions, based on the situation, that are preferably obtained from appropriate authorities (i.e., the Red Cross, the American Heart Association, etc.). The initial questions may include: "Is the victim an infant?"; "Is victim choking?"; "Is victim breathing?"; and "Does victim have a pulse?".

For child and adult choking victims, emergency instructions, preferably obtained from appropriate authorities (i.e., the Red Cross, the American Heart Association, etc.), that are displayed in a scrolling manner on the LCD digital display area 14 may include: "Dial 911 if possible for assistance."; "Perform abdominal thrusts until the object comes out."; "If victim is unconscious, clear airways of any obstructions."; "Administer 2 slow breaths."; and "If air won't go in, give five abdominal thrusts. Repeat these steps until air goes in the victim or help arrives.". A separate set of instructions for infants will be displayed for infants requiring emergency procedures. Once the user has visually observed all of the instructions on the scrolling digital LCD display, the instructions begin to repeat themselves. The watch will provide audible beeps to assist the user in timing the frequency of breaths or compressions/breaths that should be administered. A single low-pitch beep will alert the user when each compression should be performed and two short, quick, high-pitched peeps when rescue breathing is required.

For child and adult victims not breathing, emergency instructions, preferably obtained from appropriate authorities (i.e., the Red Cross, the American Heart Association, etc.), that are displayed in a scrolling manner on the LCD digital display area 14 may include: "Dial 911 if possible for assistance."; "Tilt head back, lift chin, pinch nose."; "Give 2–3 slow breaths."; "Check for breathing—'look, listen and feel.'"; "Check Carotid pulse in neck for 10 seconds."; and "If pulse but no breathing, start rescue breathing—1 breath every 4 to 5 seconds.". A separate set of instructions for infants will be displayed for infants requiring emergency procedures. Once the user has visually observed all of the instructions on the scrolling digital LCD display, the instructions begin to repeat themselves. The watch will provide audible beeps to assist the user in timing the frequency of breaths or compressions/breaths that should be administered. A single low-pitched beep will alert the user when each compression should be performed and two short, quick, high-pitched peeps when rescue breathing is required.

For child and adult victims not breathing and having no pulse, emergency instructions, preferably obtained from appropriate authorities (i.e., the Red Cross, the American Heart Association, etc.), that are displayed in a scrolling manner on the LCD digital display area 14 may include: "Dial 911 if possible for assistance."; "Perform compression/breathing cycles—4 cycles or 15 compressions and 2 slow breaths (12–15 seconds per cycle).."; "Observe chest rise and fall, listen and feel for escaping air."; and "Check Carotid pulse in the neck for 5 seconds, repeat steps until victim is breathing or help arrives.". A separate set of instructions for infants will be displayed for infants requiring emergency procedures. Once the user has visually observed all of the instructions on the scrolling digital LCD display, the instructions begin to repeat themselves. The watch will provide audible beeps to assist the user in timing the frequency of breaths or compressions/breaths that should be administered. A single low-pitch beep will alert the user when each compression should be performed and two short, quick, high-pitched peeps when rescue breathing is required.

It is to be understood that the present invention is not limited to the sole embodiment described above, but encompasses any and all embodiments within the scope of the following claims.

We claim:

1. A multi functional analog digital watch comprising:

a watch housing having a display;

a microcomputer within said watch housing, said microcomputer including a data memory and a programmable logic unit, said data memory having information relating to cardiopulmonary resuscitation (CPR) stored therein;

an analog display area within said display for displaying time of day;

a digital display area within said display for displaying one of multiple watch functions, wherein said watch functions consist of a time function, a date function, a timer function, a stopwatch function and a CPR information-related function;

a LIGHT button extending from said watch housing, said LIGHT button actuating light means to illuminate said analog display area and said digital display area;

a MODE button extending from said watch housing and electronically communicating with said microcomputer, said MODE button selecting one of said watch functions that is displayed in said digital display area; and a YES-SET-RESET button and a NO-START-STOP button separately extending from said watch housing and electronically communicating with said microcomputer, said YES-SET-RESET button and said NO-START-STOP button being independently actuated in response to a question relating to cardiopulmonary resuscitation (CPR) displayed in said digital display area when a selected one of said watch functions is said CPR information-related function, whereby each YES and NO answer is registered by the microcomputer which is automatically programmed to display in a scrolling manner an appropriate sequence of instructions or questions relating to cardiopulmonary resuscitation (CPR).

2. The multi functional analog digital watch according to claim 1, wherein said YES-SET-RESET button and said NO-START-STOP button being further actuated to control operation of a timer and a stopwatch when the selected one of said watch functions is the respective timer function and the stopwatch function.

3. The multi functional analog digital watch according to claim 1, wherein said analog display area includes a minute hand and an hour hand.

4. The multi functional analog digital watch according to claim 1, further including an audible alarm that periodically sounds for a predetermined time.

5. The multi functional analog digital watch according to claim 1, wherein said digital display area comprises a liquid crystal display (LCD) for displaying two or more lines of alphanumeric characters.

6. The multi functional analog digital watch according to claim 1, wherein said digital display area comprises a scrolling liquid crystal display (LCD) capable of displaying two or more lines of alphanumeric characters.

7. The multi functional analog digital watch according to claim 1, wherein said watch housing is water-resistant.

* * * * *